US005934791A

United States Patent [19]

Van Gennip et al.

[11] Patent Number: 5,934,791

[45] Date of Patent: Aug. 10, 1999

[54] ELECTRIC LAMP

[75] Inventors: Nicasius G.T. Van Gennip; Petrus J.M. Fransen, both of Eindhoven, Netherlands; Winand H.A.M. Friederichs, Bath, N.Y.; Petrus H. Antonis, Eindhoven, Netherlands

[73] Assignee: U.S. Phillips Corporation, New York, N.Y.

[21] Appl. No.: 08/834,405

[22] Filed: Apr. 16, 1997

[30] Foreign Application Priority Data

Apr. 19, 1996 [EP] European Pat. Off. ..... 96201063

[51] Int. Cl.[6] ..... H01J 1/50

[52] U.S. Cl. ..... 362/226; 362/263; 313/318.01; 313/318.1; 313/35

[58] Field of Search ..... 362/226, 267, 362/457, 263; 313/318.01, 318.1, 35, 161, 46, 318.09

[56] References Cited

U.S. PATENT DOCUMENTS

| | | | |
|---|---|---|---|
| 5,211,472 | 5/1993 | Friederichs et al. | 362/226 |
| 5,744,901 | 4/1998 | Friederichs et al. | 362/226 |
| 5,804,911 | 9/1998 | Van Gennip et al. | 313/318.01 |

FOREIGN PATENT DOCUMENTS 2421328 10/1979 France .

*Primary Examiner*—Thomas M. Sember
*Attorney, Agent, or Firm*—F. Brice Faller

[57] ABSTRACT

An electric lamp according to the invention comprises a lamp vessel (10) which is closed in a gastight manner, which has an end portion (11), and which surrounds a light source (12). The lamp vessel supports a cylindrical collar (30) with an axis (31) at its end portion (11). One or several projections (33*a*, 33*b*, 33*c*) of a first coupling member (30) which each grip into a respective recess (41*a*, 41*c*) of a second coupling member (40) couple the collar (30) to a mounting member (40) for fastening the lamp to a carrier. At least one of the coupling members (30) is made of an elastic material. The second coupling member (40) has two or more axial zones (43, 43') each with at least one recess (41*a*, 41*b*, 41*c*; 41*a'*, 41*b*, 41*c'*) and a raised step (42*a*, 42*b*, 42*c*; 42*a'*, 42*b'*, 42*c'*) which bounds the recess in tangential direction, while a raised step (42*a*, 42*b*, 42*c*) of an axial zone (43) also forms part of an axial boundary of a recess (41*a'*, 41*c'*) of an adjoining axial zone (43') each time, and the raised steps and the one or several projections (33*a*, 33*b*, 33*c*) have mutually self-locating shapes in at least one tangential direction. The construction of the lamp according to the invention renders it possible to remove the lamp vessel from the mounting member without the use of a tool, but counteracts an inadvertent removal.

4 Claims, 5 Drawing Sheets

ELECTRIC LAMP

BACKGROUND OF THE INVENTION

The invention relates to an electric lamp comprising a lamp vessel which is closed in a gastight manner, which is provided with an end portion, which surrounds a light source, and which supports a cylindrical collar with an axis at its end portion. One or several projections of a first coupling member each grip into a respective recess of a second coupling member to couple the collar to a mounting member for fastening the lamp to a carrier, at least one of the coupling members being made of an elastic material.

Such a lamp is known from U.S. Pat. No. 5,211,472. The known lamp is an electrodeless low-pressure discharge lamp which is operated on a voltage source with a high frequency. The lamp vessel which is internally coated with a fluorescent powder, has in its end portion a cavity in which an electric coil is accommodated, which coil is supported by the mounting member. A voltage of several hundred V is present across the coil during lamp ignition. The coil generates a high electromagnetic field strength during ignition and during burning. A removal of the lamp vessel while the coil is in the energized state may be dangerous and may cause damage. Serious radio interference may occur, and the supply of the lamp may become defective owing to the removal of the load.

The first and the second coupling member in the known lamp are formed by the collar and the mounting member, respectively. The projections of the collar may, for example, each grip into an individual recess, or may alternatively cooperate with a common recess which is formed, for example, by a circumferential groove.

Although a random removal of the lamp vessel is not allowed, it is nevertheless desirable for the lamp vessel to be exchangeable, for example for replacing a defective lamp vessel, for example a damaged and leaky one, or for mounting a lamp vessel having a fluorescent powder which generates light of a different color. The known lamp for this purpose has a construction which renders it possible to remove the lamp vessel from the mounting member by means of a special tool. The user who wants to detach the lamp vessel must apply the tool to locations of the mounting member specially designed for this while at the same time rotating the collar together with the lamp vessel. It is a disadvantage that the user requires both hands for this. In addition, lamp removal may be very difficult if the lamp is badly accessible, for example because little space is available around the lamp.

SUMMARY OF THE INVENTION

It is an object of the invention to provide an electric lamp which renders it possible to remove the lamp vessel from the mounting member without the use of tools and which nevertheless counteracts an inadvertent removal.

According to the invention, the second coupling member has two or more axial zones each with at least one recess, and a raised step which bounds the recess tangentially, a raised step of an axial zone at the same time forming part of an axial boundary of a recess of an adjoining axial zone, while the raised steps and the one or several projections have mutually self-locating shapes in at least one tangential direction.

In an embodiment, the first coupling member has one or several projections which cooperate with a single recess and a single raised step in each of the axial zones. A preferred embodiment, however, is one in which the first coupling member comprises a plurality of projections, for example three, and the second coupling member has an identical number of recesses and raised steps. The wording of the ensuing description relates to the latter embodiment for reasons of clarity. The description, however, is equally applicable to the former embodiment.

In the lamp according to the invention, the collar with the lamp vessel is coupled to the mounting member by means of the projections of the first coupling member which grip into the recesses of the second coupling member. The collar with the lamp vessel can be uncoupled from the mounting member without the use of a tool. The collar is rotated relative to the mounting member for this purpose until the projections rest on the raised steps. Then it is possible to pass the projections from the raised steps into the recesses of the next axial zone by means of an axial displacement of the collar relative to the mounting member. The operations of rotation and axial displacement can be repeated until the projections have left the final axial zone and the collar with the lamp vessel is uncoupled from the mounting member. Since a series of mutually differing movements is necessary for removing the collar with the lamp vessel from the mounting member, it is avoided that an inadvertent removal can take place as a result of a random movement.

In an embodiment, the mounting member and the collar form the first and the second coupling member, respectively. An attractive embodiment of the lamp according to the invention is characterized in that the first and the second coupling member are formed by the collar and the mounting member, respectively.

A favorable embodiment of the lamp according to the invention is characterized in that one or several projections of the first coupling member and raised steps of the second coupling member have mutually cooperating profiles which allow of an axial displacement between the collar and the mounting member. The mutual engagement of the mutually cooperating profiles after a rotation renders it clear to the user that the collar may subsequently be displaced in axial direction relative to the mounting member.

An advantageous embodiment is characterized in that the recesses of the second coupling member are bounded by tangential ridges, said tangential ridges and the one or several projections having mutually self-locating shapes during a displacement of the mounting member towards the lamp vessel, whereas the ridges block the one or several projections in an opposite direction. The mutually self-locating shapes of the ridges and projections upon a displacement of the mounting member towards the lamp vessel render it possible to fasten the collar with the lamp vessel on the mounting member in a single translatory movement.

It is obvious that the nature of the light source is immaterial to the essence of the invention. The light source may be, for example, an incandescent body or a rare gas with metal halides, for example in a lamp vessel with a discharge path between electrodes, or alternatively with a discharge path around an electric coil.

DETAILED DESCRIPTION OF THE PREFERRED EMBODIMENT

Figure 1:
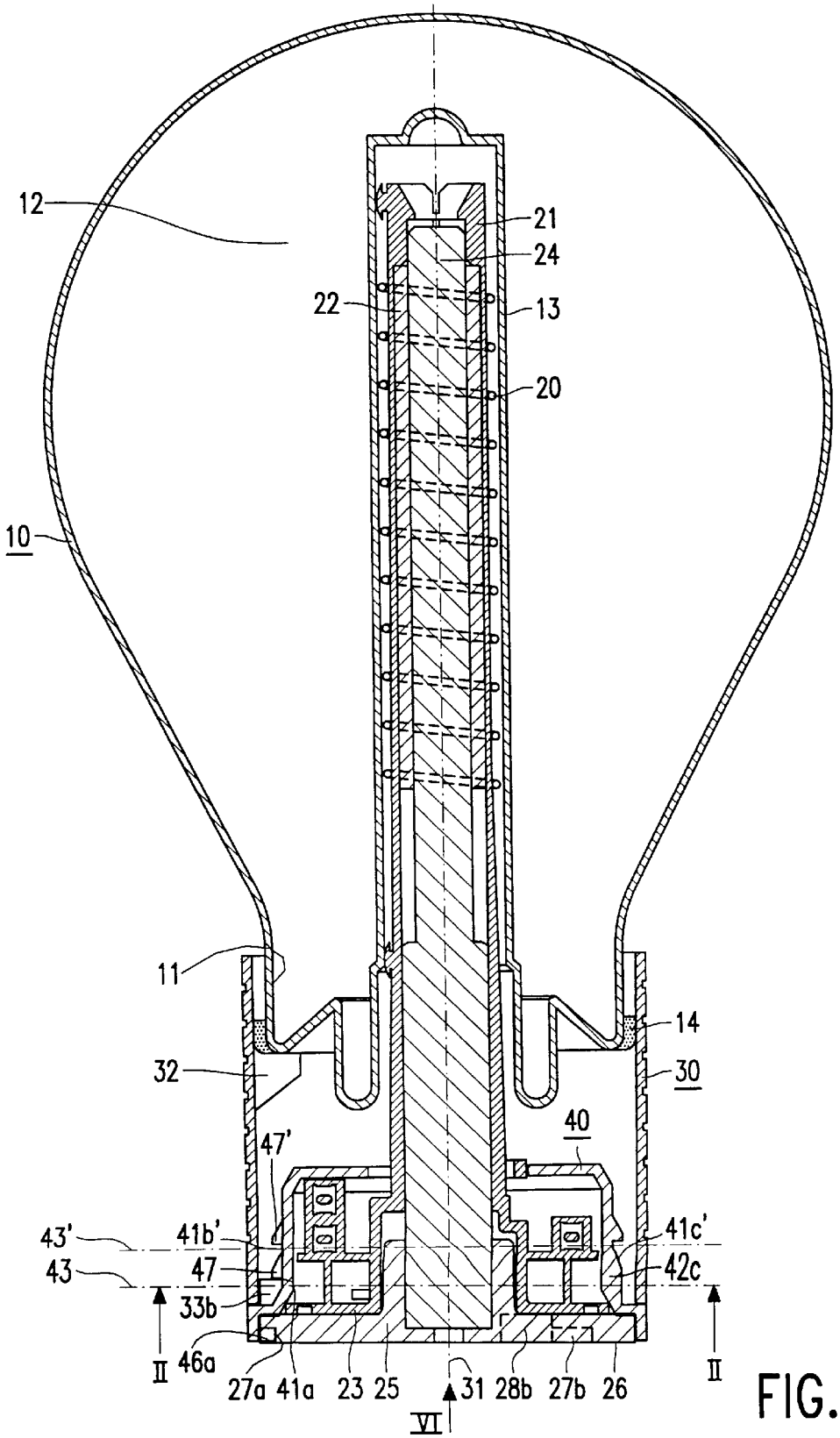
FIG. 1 is a longitudinal sectional view of a lamp according to the invention.

The electric lamp shown in FIG. 1 has a lamp vessel 10 which is closed in a gastight manner and has an end portion 11. A light source 12 in the lamp vessel is formed by an ionizable medium, mercury and a rare gas in this case. An electric discharge is maintained in the ionizable medium during lamp operation by means of an electric coil 20 which is arranged in a cavity 13 of the lamp vessel. The coil 20 is provided around a coil former 21 in which a core 22 of soft magnetic material is accommodated and which has a widened end 23. A heat conductor 24 is enclosed in the core 22 of soft magnetic material and extends to outside the coil former, where it has a flange 25.

Figure 4:
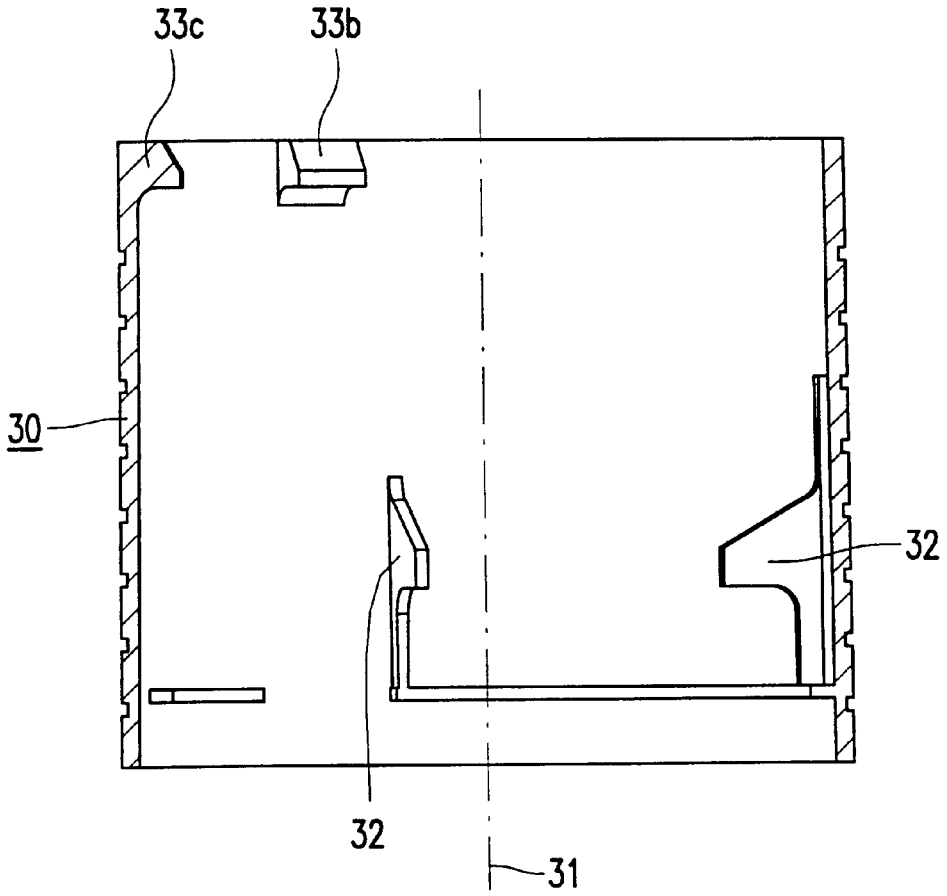
FIG. 4 is a cross-section taken on the line IV—IV in FIG. 2 of the first coupling member.

The lamp vessel 10 has a cylindrical collar 30 (see also FIG. 4) with an axis 31 at its end portion 11. The collar is fixed to the end portion 11 of the lamp vessel 10 by means of cement 14. In addition, the end portion rests on supports 32 in the collar. Alternatively, the end portion may be, for example, clamped in tightly in the collar.

Figure 2:
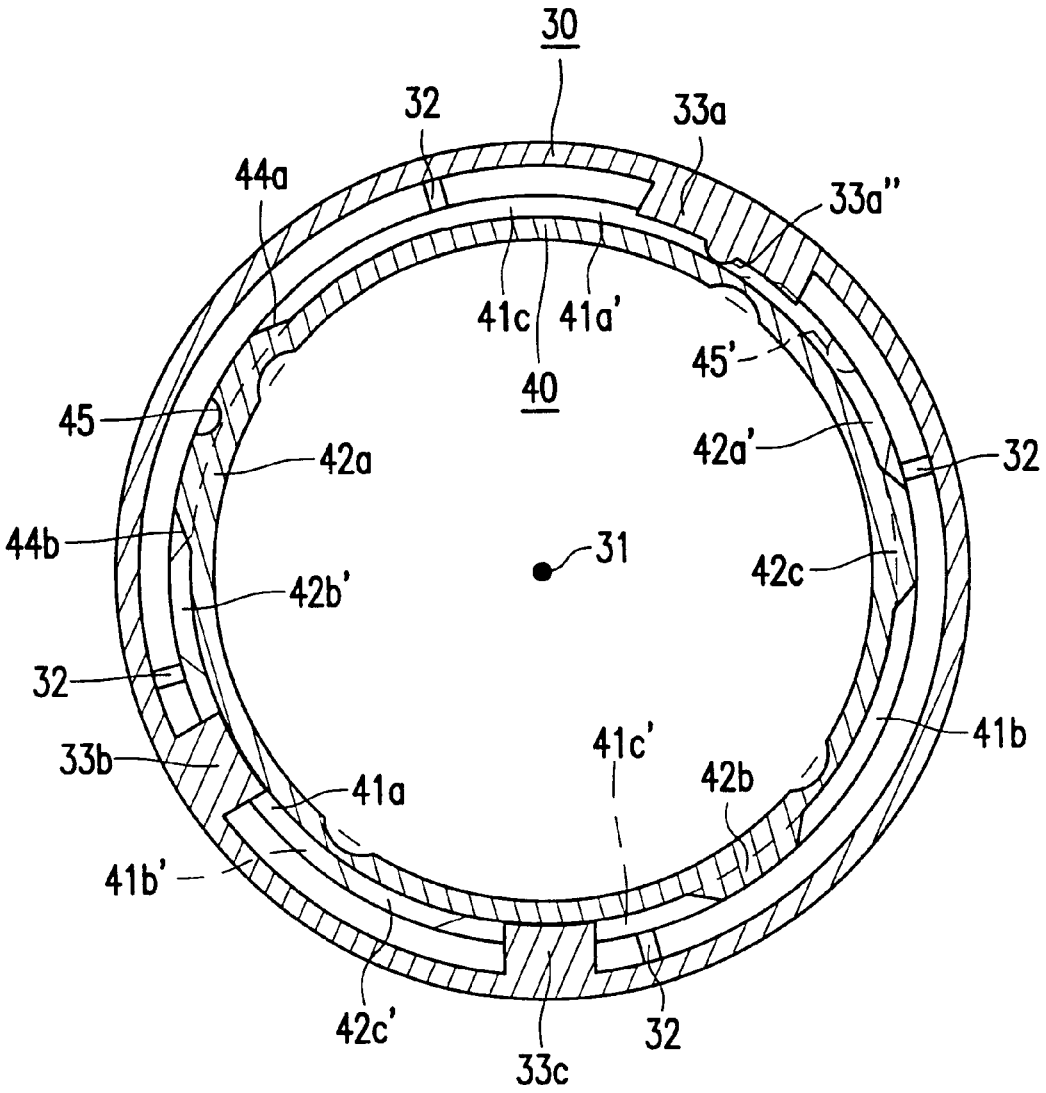
FIG. 2 is a cross-section taken on the line II—II in FIG. 1 of the coupling members in a first tangential position relative to one another.
Figure 5:
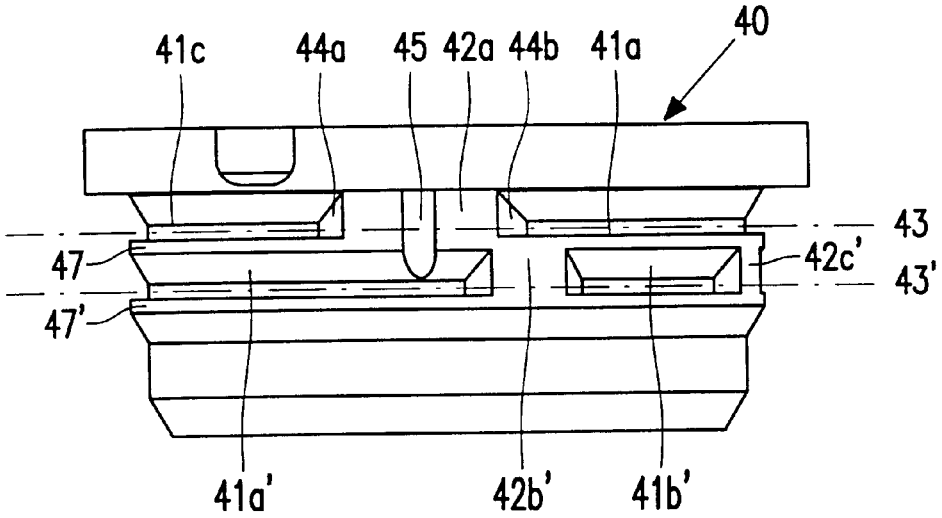
FIG. 5 is an elevation seen along V in FIG. 2 of the second coupling member.

The lamp comprises a mounting member 40 (see also FIG. 5) for fastening the lamp to a carrier. FIG. 2 shows that one or several projections 33*a*, 33*b*, 33*c* of a first coupling member 30 enter recesses 41i c,41*a* of a second coupling member 40 so as to couple the collar 30 to the mounting member 40. At least one of the coupling members is made of an elastic material. The collar 30, which here forms the first coupling member, is made from an elastic synthetic resin such as polyether imide, polyether sulphon, or polyether sulphide.

The second coupling member 40, which is formed by the mounting member here, has two or more axial zones each with at least one recess and a raised step which tangentially bounds the recess. The second coupling member 40 here has a first and a second axial zone 43, 43' with three recesses each, 41*a*, 41*b*, 41*c* and 41*a'*, 41*b'*, 41*c'*, respectively, the recesses of the first axial zone 43 being mutually separated by raised steps 42*a*, 42*b*, 42*c*, and those of the second axial zone by steps 42*a'*, 42*b'*, 42*c'*. FIG. 2 shows the first axial zone 43 in cross-section. The second axial zone has the same shape as the first. The entire arrangement of raised steps and recesses, however, is rotated through 120° relative to that of the first zone. The circumference of the second axial zone is shown by means of broken lines in FIG. 2.

Step 42*a* and steps 42*b*, 42*c* in the first axial zone 43 also form part of an axial boundary of recess 41*a'* and recess 41*c'*, respectively, of the second, adjoining axial zone 43'. The raised steps 42*a*, 42*b*, 42*c*, 42*a'*, 42*b'*, 42*c'* have beveled edges on both sides, so that the raised steps and the projections have mutually self-locating shapes in both tangential directions. The edges of raised step 42*a* only have been given reference numerals (44*a*, 44*b*) for the sake of clarity. A projection 33*a* of the first coupling member 30 and raised steps 42*a*, 42*a'* of the second coupling member 40 have mutually cooperating profiles which allow an axial displacement between the collar and the mounting member. The projection 33*a* here has an axial ridge 33*a"*, while a raised step 42*a*, 42*a'* has an axial groove 45, 45' in each of the axial zones.

Figure 6:
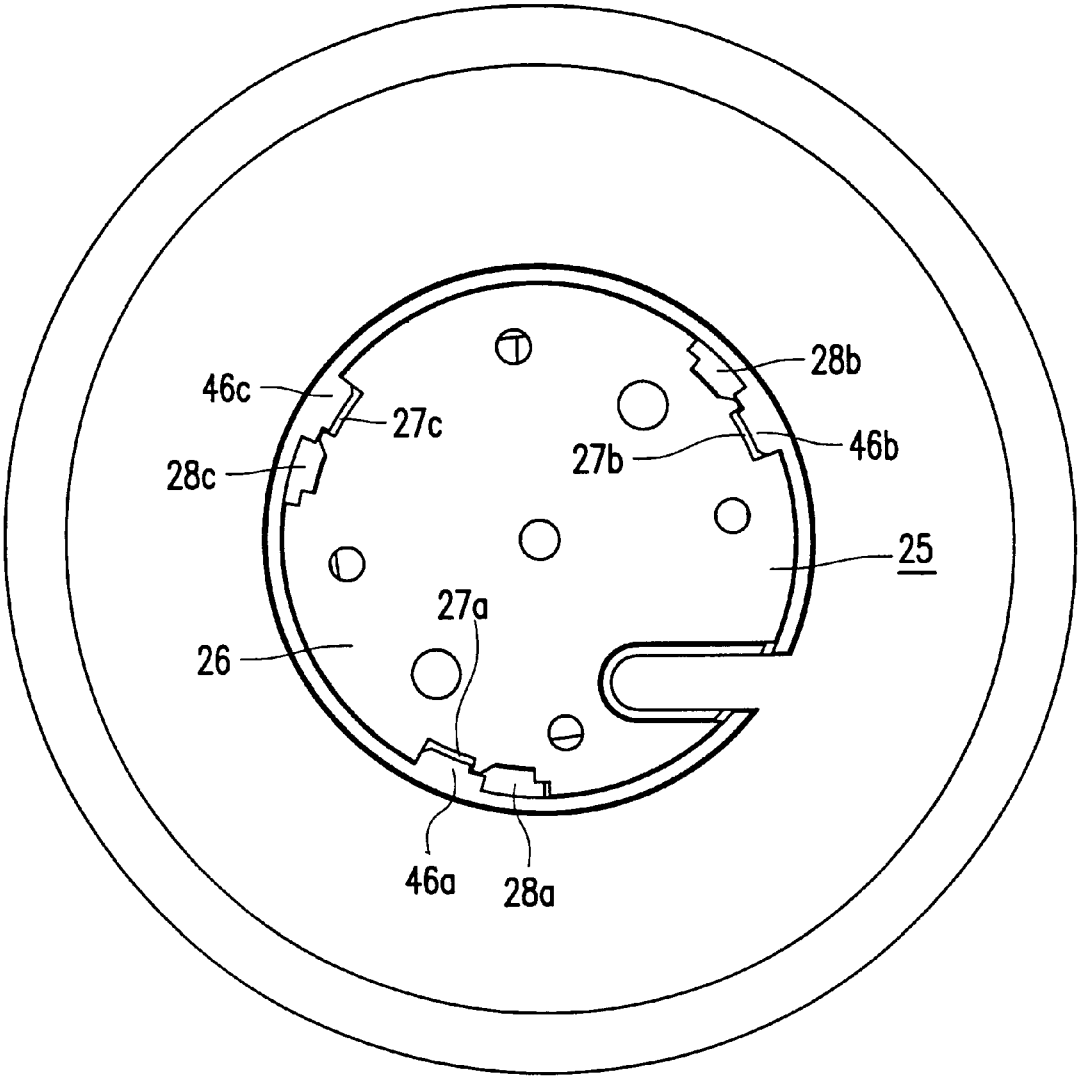
FIG. 6 is an end view seen along VI in FIG. 1.

FIG. 6 shows that the mounting member 40 is provided with hooks 46*a*, 46*b*, 46*c* which point radially inwards and which cooperate with recesses 27*a*, 27*b*, 27*c* in the surface 26 of the flange 25 which faces away from the lamp vessel 10. The recesses 27*a*, 27*b*, 27*c* each issue into an axial slot 28*a*, 28*b* 28*c* which is present at the circumference of the flange and extends into the surface facing the lamp vessel. The widened end 23 of the coil former 21 is clamped between the flange 25 and the mounting member 40.

Figure 3:
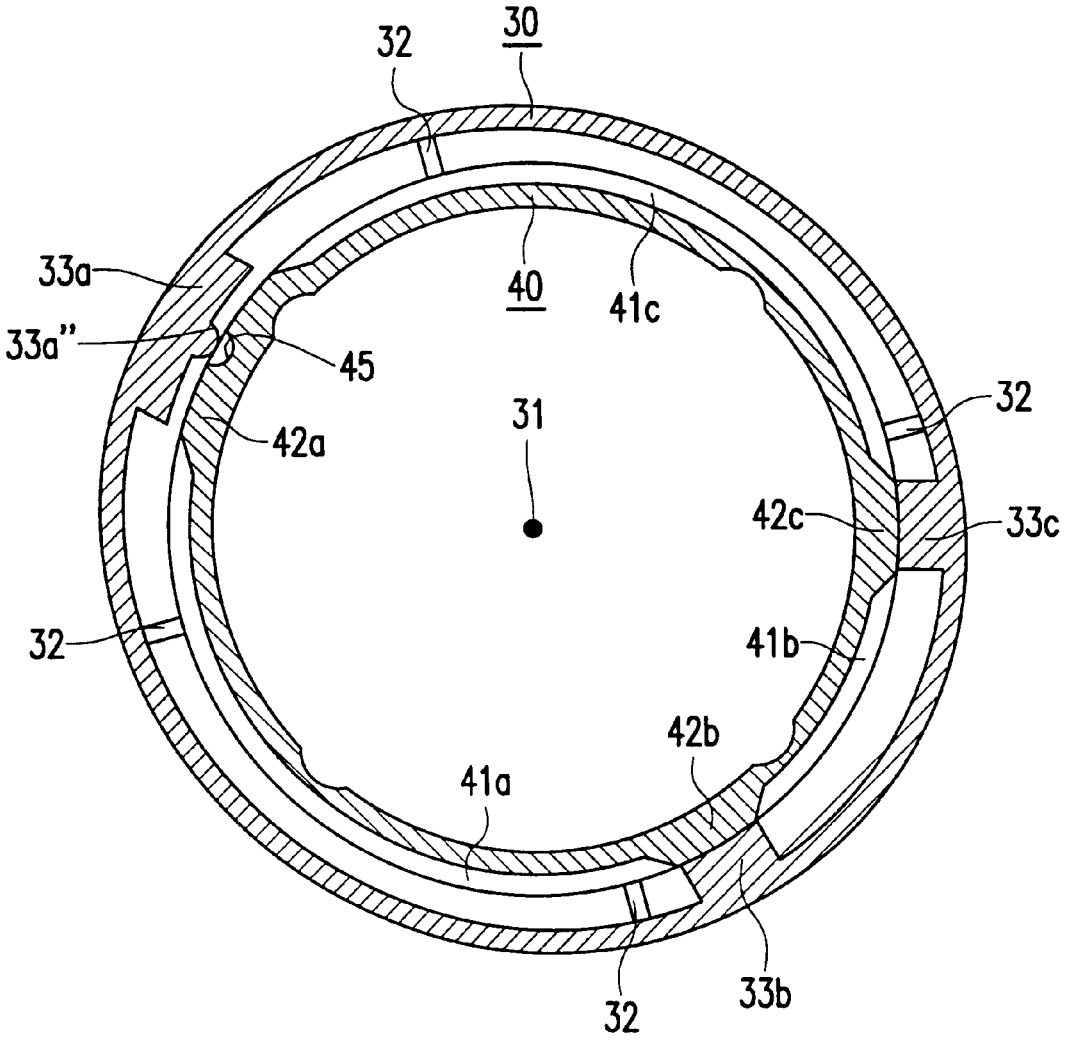
FIG. 3 is a cross-section taken on the line II—II in FIG. 1 of the coupling members in a second tangential position relative to one another.

The coupling between the mounting member 40 and the collar 30 with the lamp vessel 10 can be eliminated by means of a succession of a first rotation, a first axial translation, a second rotation, and a second axial translation of the collar 30 relative to the mounting member 40. During the first rotation, the projections 33*a*, 33*b*, 33*c* of the collar are rotated onto the steps 42*a*, 42*b*, 42*c* of the first axial zone 43 (see FIG. 3). The axial ridge 33*a"* of projection 33*a* snaps itself into the axial groove 45 of raised step 42*a* during this.

In the first axial translation of the collar 30, the projections 33*a*, 33*b*, 33*c* slide from the raised steps 42*a*, 42*b*, 42*c* of the first axial zone 43 into recesses 41*a'*, 41*c'* of the adjacent, second axial zone 43'. In the second rotation, the collar 30 is rotated until its projections 33*a*, 33*b*, 33i crest on the raised steps 42*a'*, 42*b'*, 42*c'* of the second axial zone 43'. Finally, the collar 30 with the lamp vessel 10 can be removed from the mounting member 40 by means of the second axial translation.

The recesses 41*a*, 41*b*, 41*c*, 41*a'*, 41*b'*, 41*c'* of the second coupling member 40 are bounded by tangential ridges 47, 47', whose sides facing the lamp vessel are beveled. The projections 33*a*, 33*b*, 33*c* of the collar 30 are beveled at a side facing away from the lamp vessel. As a result of this, the tangential ridges and the projections have mutually self-locating shapes in the case of a displacement of the mounting member 40 towards the lamp vessel 10. In an opposed direction, the ridges 47, 47' will block the projections 33*a*, 33*b*, 33*c*. This renders it possible to fasten the collar with the lamp vessel on the mounting member in a single axial translation.

We claim:

1. An electric lamp comprising a lamp vessel (10) which is closed in a gastight manner, which is provided with an end portion (11), which surrounds a light source (12), and which supports a cylindrical collar (30) with an axis (31) at said end portion (11), while one or several projections (33*a*, 33*b*, 33*c*) of a first coupling member (30) each gripping into a respective recess (41*a*, 41*c*) of a second coupling member (40) couple the collar (30) to a mounting member (40) for fastening the lamp to a carrier, at least one of said coupling members (30) being made of an elastic material, characterized in that the second coupling member (40) has two or more axial zones (43, 43') each with at least one recess (41*a*, 41*b*, 41*c*; 41*a'*, 41*b'*, 41*c'*), and a raised step (42*a*, 42*b*, 42*c*; 42*a'*, 42*b'*, 42*c'*) which bounds the recess tangentially, a raised step (42*a*, 42*b*, 42*c*) of an axial zone at the same time forming part of an axial boundary of a recess (41*a'*, 41*c'*) of an adjoining axial zone (43'), while the raised steps and the one or several projections (33*a*, 33*b*, 33*c*) have mutually self-locating shapes in at least one tangential direction.

2. An electric lamp as claimed in claim 1, characterized in that the first and the second coupling member are formed by the collar (30) and the mounting member (40), respectively.

3. An electric lamp as claimed in claim 1, characterized in that one or several projections (33*a*) of the first coupling member (30) and raised steps (42*a*, 42*a'*) of the second coupling member (40) have mutually cooperating profiles (33*a"*; 45, 45') which allow of an axial displacement between the collar (30) and the mounting member (40).

4. An electric lamp as claimed in claim 1, characterized in that the recesses (41*a–c*; 41*a'–c'*) of the second coupling member (40) are bounded by tangential ridges (47, 47'), said tangential ridges and the one or several projections (33*a–c*) having mutually self-locating shapes during a displacement of the mounting member towards the lamp vessel (10), whereas the ridges block the one or several projections in an opposite direction.

* * * * *